US011166519B2

(12) United States Patent
Gurrola

(10) Patent No.: US 11,166,519 B2
(45) Date of Patent: Nov. 9, 2021

(54) SPORT SANDAL

(71) Applicant: Jorge Luis Gurrola, Los Angeles, CA (US)

(72) Inventor: Jorge Luis Gurrola, Los Angeles, CA (US)

( * ) Notice: Subject to any disclaimer, the term of this patent is extended or adjusted under 35 U.S.C. 154(b) by 0 days.

(21) Appl. No.: 16/404,623

(22) Filed: May 6, 2019

(65) Prior Publication Data

US 2019/0335845 A1 Nov. 7, 2019

Related U.S. Application Data

(60) Provisional application No. 62/667,425, filed on May 5, 2018.

(51) Int. Cl.
*A43B 3/12* (2006.01)
*A43C 11/14* (2006.01)

(52) U.S. Cl.
CPC ..... *A43B 3/122* (2013.01); *A43B 3/126* (2013.01); *A43C 11/1493* (2013.01)

(58) Field of Classification Search
CPC ..... A43B 3/10; A43B 3/126; A43B 3/122
See application file for complete search history.

(56) References Cited

U.S. PATENT DOCUMENTS 2,808,662 A * 10/1957 Helene ..... A43B 3/126 36/11.5
4,584,782 A 4/1986 Thatcher
4,793,075 A 12/1988 Thatcher
D333,904 S 3/1993 Eminger
5,228,216 A 7/1993 Sargeant
5,802,737 A * 9/1998 Beppu ..... A43B 3/105 36/11.5
5,870,837 A * 2/1999 Poulos ..... A43B 3/105 36/11.5
5,961,544 A 10/1999 Goldman et al.
6,151,801 A * 11/2000 Frederiksen ..... A43B 3/105 36/11.5
6,237,250 B1 * 5/2001 Aguerre ..... A43B 3/122 36/11.5
6,543,157 B2 4/2003 Pan
D478,713 S 8/2003 Scheurer
D483,930 S 12/2003 Scheurer
7,596,887 B2 * 10/2009 McClellan ..... A43B 3/105 36/11.5
8,832,971 B2 * 9/2014 Heid ..... A61F 5/019 36/94
9,635,899 B2 * 5/2017 Sashen ..... A43B 3/126
2003/0029056 A1 * 2/2003 Frederiksen ..... A43B 3/105 36/11.5
2013/0160326 A1 6/2013 Szekeresh
(Continued)

*Primary Examiner* — Jila M Mohandesi
(74) *Attorney, Agent, or Firm* — Sheppard, Mullin, Richter & Hampton, LLP

(57) ABSTRACT

A sport sandal having a sole and a securement mechanism coupled to the sole. The securement mechanism has a brace, which couples a plurality of toe posts to a plurality of lateral supports. The securement mechanism also has a heel leash coupled to the plurality of lateral supports. The sport sandal provides a user with improved forefront control, improved lateral side traction on the user's toes, improved comfort, and a reduction of forward pressure on the user's toes.

18 Claims, 6 Drawing Sheets

(56) References Cited

U.S. PATENT DOCUMENTS

| | | | | |
|---|---|---|---|---|
| 2015/0027004 | A1* | 1/2015 | Conrad | A43B 3/103<br>36/102 |
| 2017/0325540 | A1* | 11/2017 | Opalacz | A43B 3/126 |
| 2018/0007997 | A1* | 1/2018 | Young | A43B 13/12 |

* cited by examiner

SPORT SANDAL

CROSS REFERENCE TO RELATED APPLICATIONS

This application claims the benefit of U.S. Provisional Application No. 62/667,425, filed May 5, 2018, the entire disclosure of which is incorporated herein by reference.

BACKGROUND

Traditional sandals provide the benefit of additional comfort by not constraining feet to the confines of enclosed shoes. However, traditional sandals do not provide adequate footbed support and do not adequately keep the foot secured to the sandal in a manner necessary for outdoor activities, such as hiking or other adventure activities in non-uniform terrain. There is a need for a sandal that can be used for such outdoor and adventure activities that provides adequate footbed support and connection to the foot.

SUMMARY OF THE INVENTION

According to various embodiments of the technology, disclosed herein is a sport sandal comprising a brace system and a plurality of toe posts for increased support and stability. In embodiments, the sport sandal may have a sole comprising a plurality of stacked layers. In specific implementations, the plurality of layers may have different sizes to accommodate the shape of a foot and to provide arch support. In implementations, the plurality of layers may be pressed together to form a laminate of the plurality of layers.

In implementations, the sport sandal may comprise a securement mechanism. The securement mechanism of the present disclosure may comprise a brace and plurality of toe posts. In embodiments, the toe posts may be fixed to the sole and the brace. In embodiments, the plurality of toe posts may be coupled to the sole at a location such that each of the toe posts may fit directly between two toes when worn by a user. In some implementations, the brace may comprise a plurality of appendages connecting the plurality of toe posts to other components of the sport sandal.

In embodiments, the securement mechanism may also include a plurality of lateral supports, which may be coupled to the brace. In one embodiment, the plurality of lateral supports may be coupled to the sole and extend substantially vertically to connect to the brace. In some implementations, the brace may be connected to the lateral supports by one or more straps. In embodiments, the straps may be connected to the brace and configured to adjust the size of the securement mechanism to accommodate feet of various sizes.

In embodiments, the securement mechanism may also comprise a heel leash. In such examples, the heel leash may extend around the back of the user's foot for protection and support.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Figure 1:
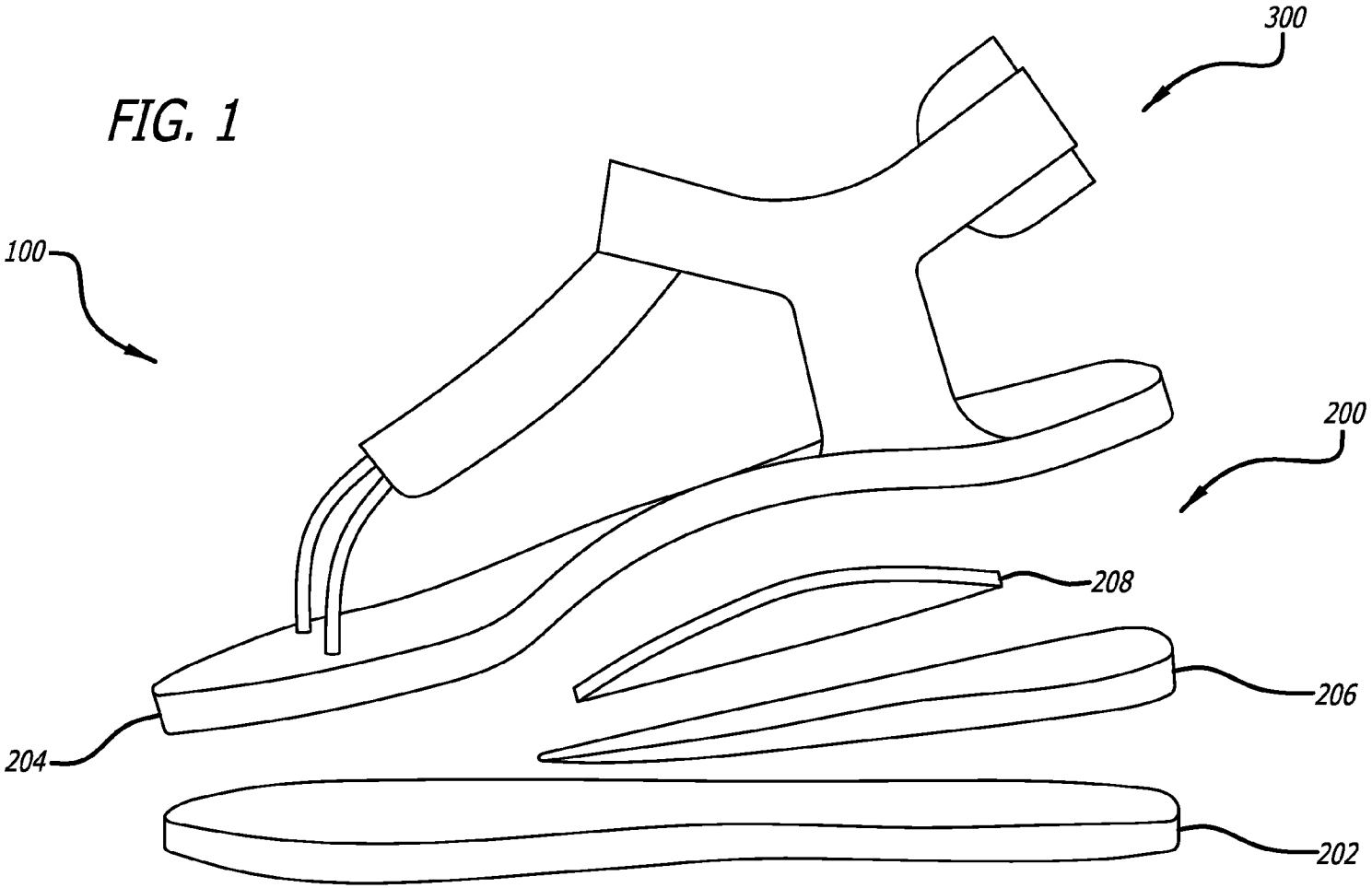
FIG. 1 depicts an exploded side view of an example sport sandal in accordance with one embodiment of the present disclosure.

FIG. 1 of the present disclosure depicts a sport sandal 100 comprising a sole 200 and a securement mechanism 300. The sole 200 may comprise a plurality of layers sandwiched together. The securement mechanism 300 may comprise a brace system coupled to a heel leash. In embodiments, the brace system may couple a plurality of toe posts 310 to a plurality of lateral supports 340, as shown, for example, in FIG. 2.

In the depicted example embodiment of FIG. 1, the sole 200 may be comprised of a plurality of layers sandwiched together. For example, the sole 200 may comprise an outsole layer 202 that forms the bottommost layer of the sport sandal 100. In embodiments, the outsole layer 202 may be comprised of rubber, leather, or any other material suitable for contact with a surface on which the sport sandal 100 is being used. The sole 200 may comprise a footsole layer 204 that forms the topmost layer of the sole of the sport sandal 100. The footsole layer 204 may be comprised of rubber, leather, or any other material comfortable for contact with the bottom of a user's foot. In between the outsole layer 202 and the footsole layer 204 may be a plurality of midsole layers. One such midsole layer may be a heel cushion 206 located near the rear of the sole 200. The heel cushion 206 may comprise an elastic material capable of absorbing shock imparted on a user's heel when using the sport sandal. Another midsole layer may be an arch support 208 located near the middle of the sole. The arch support 208 may comprise a stiffer material than the material of the heel cushion 206, providing arch support to the arch of a user's foot while using the sport sandal 100. The layers of the sole 200 may be pressed together to form a laminate of the plurality of layers that make up the sole 200.

Referring now to FIGS. 2 through 6, the securement mechanism 300 may include a plurality of toe posts 310. A first end 312 of the plurality of toe posts 310 may be coupled to the sole 200. In one example, the first end 312 of the plurality of toe posts 310 may extend through the entire sole 200.

Figure 4:
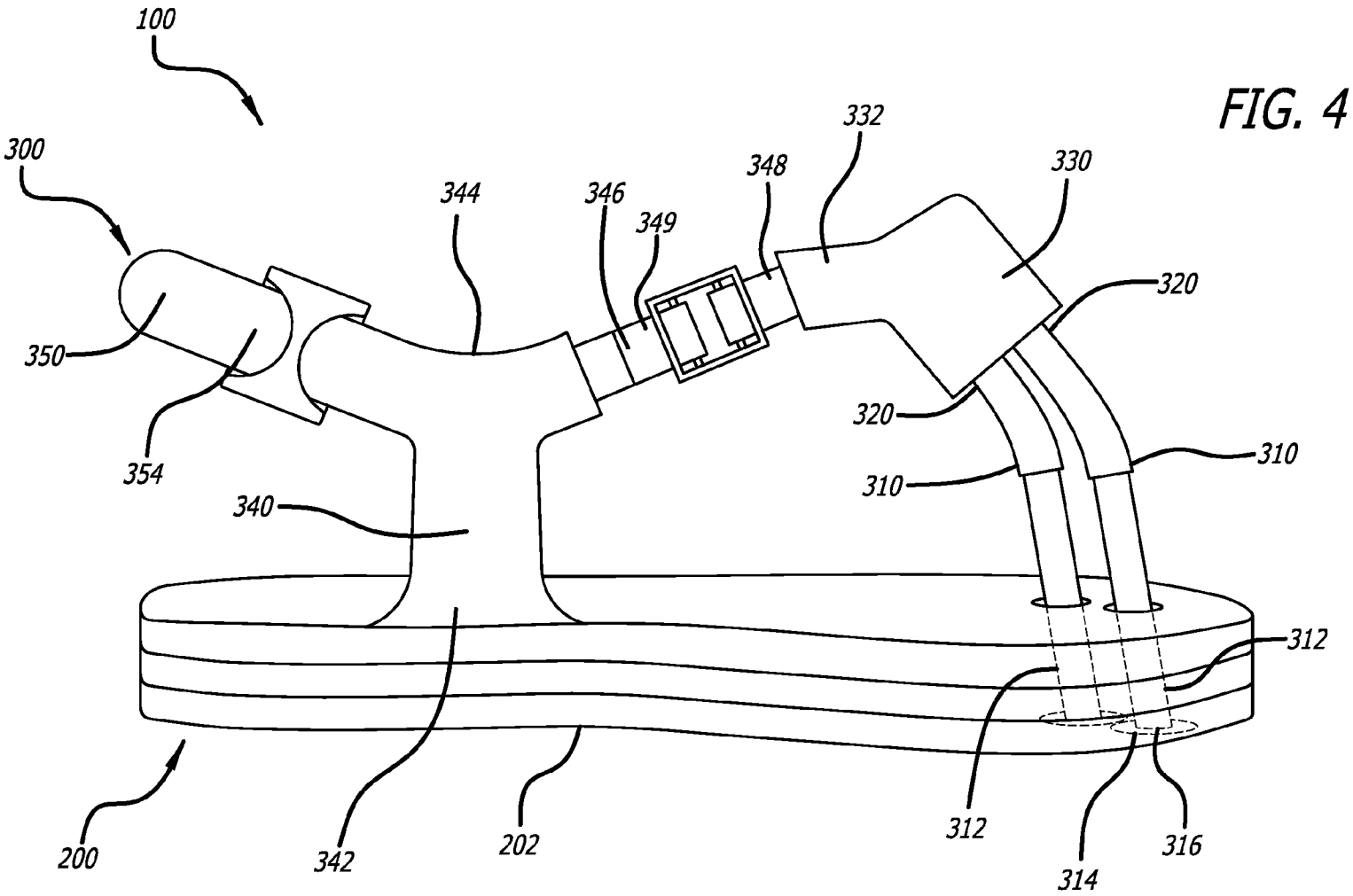
FIG. 4 depicts a side view of an example sport sandal in accordance with one embodiment of the present disclosure.

As illustrated in FIG. 4, the first end 312 may comprise a flange 314 at a terminus 316 of the first end 312, the flange being configured to contact the exterior surface of the outsole layer 202 to prevent the first end 312 of the plurality of toe posts 310 from detaching from the sole 200. In another example, the terminus 316 of the first end 312 of the plurality of toe posts 310 may be secured between two or more layers of the sole 200.

Figure 2:
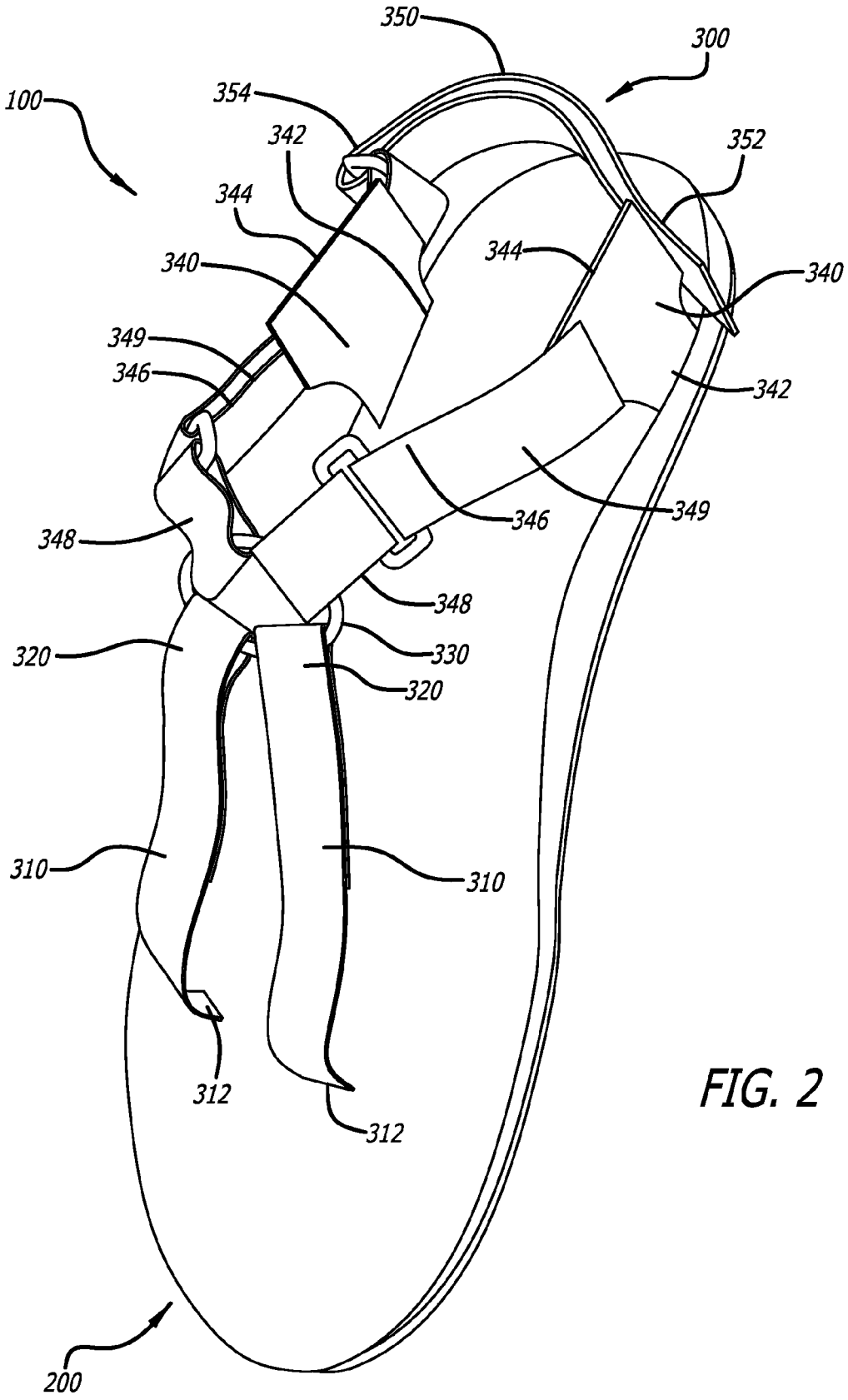
FIG. 2 depicts a perspective view of an example sport sandal in accordance with one embodiment of the present disclosure.
Figure 3:
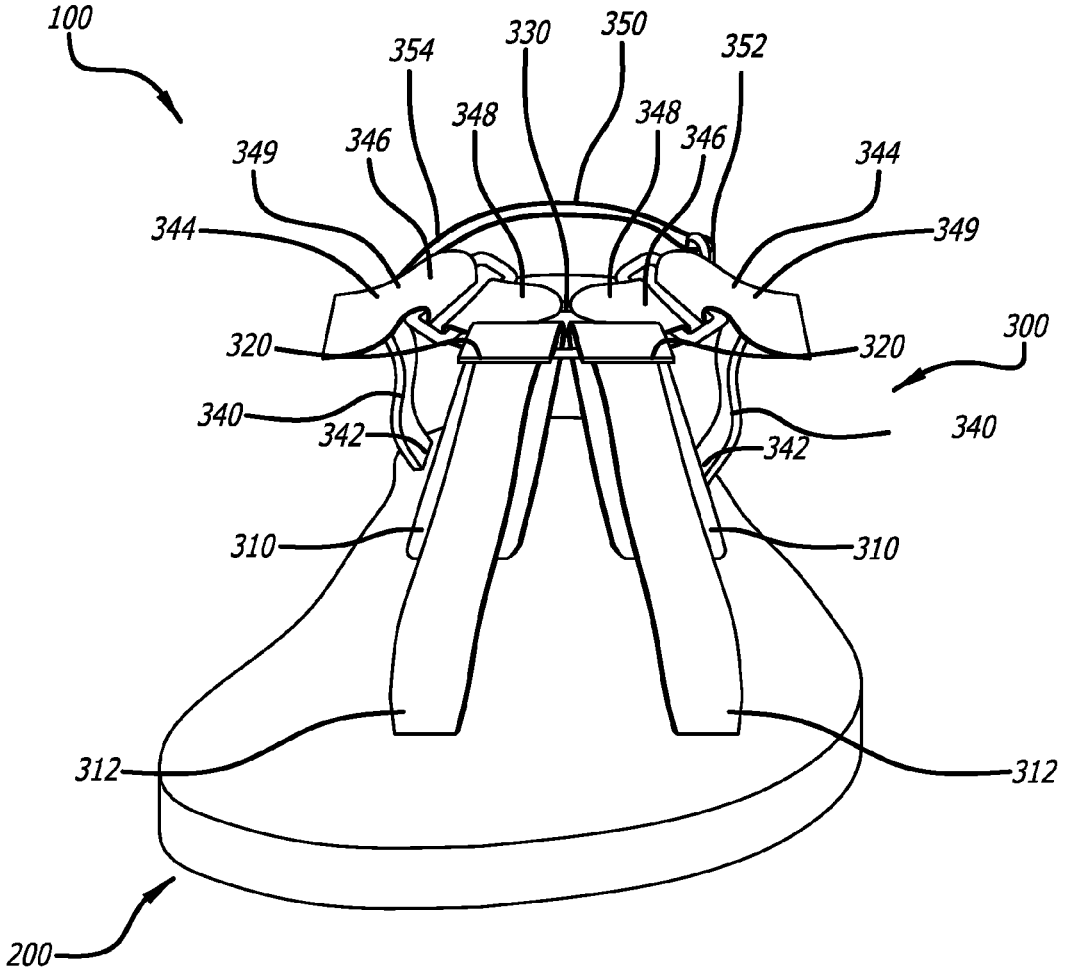
FIG. 3 depicts a front view of an example sport sandal in accordance with one embodiment of the present disclosure.

Referring to FIG. 2, each of the plurality of toe posts 310 may comprise a first end 312 and a second end 320. In embodiments, the first end 312 may be fixed to the sole 200.

The second end 320 may be coupled to a brace 330. In one example, the second end 320 of the plurality of toe posts 310 may form a closed loop through which the brace 330 may enter, thus coupling the second end 320 of the plurality of toe posts 310 to the brace 330. In another example, the second end 320 of the toe post 310 may comprise one side of a hook and loop fastener (e.g., Velcro®) and the brace 330 may include a portion to receive the hook and loop fastener of second end 320 of the toe post 310, thus coupling the second end 320 of the toe post 310 to the brace 330.

In implementations, the second end 320 of the toe post 310 may be affixed to the brace 330 by any known coupling means, including but not limited to rivets, stitching, or other coupling means described herein. For example, a buckle may be coupled to either the second end 320 of the toe post 310 or the brace 330 whereby the second end 320 of the toe post 310 may couple to the brace 330 via the buckle. In implementations, the second end 320 of the toe post may form a permanent connection with the brace 330. The plurality of toe posts 310 and the brace may form a continuous, permanent connection as a single component formed from the same material. For example, the components of the sport sandal 100 as described herein may be formed by an injection molding process using materials, including but not limited to, PVC, rubber, or thermoplastic elastomers.

In addition, the plurality of toe posts 310 may be made of, for example, rubber, canvas material, or a polypropylene webbing. In an example, the toe posts 210 may comprise a polypropylene webbing having water resistant and UV resistant properties. In embodiments, the toe posts 310 may have a thickness of about 0.040 inches, a breaking strength ranging from approximately 300 to 1,200 pounds, and/or may have a melting point of approximately 330 degrees Fahrenheit.

Figure 5:
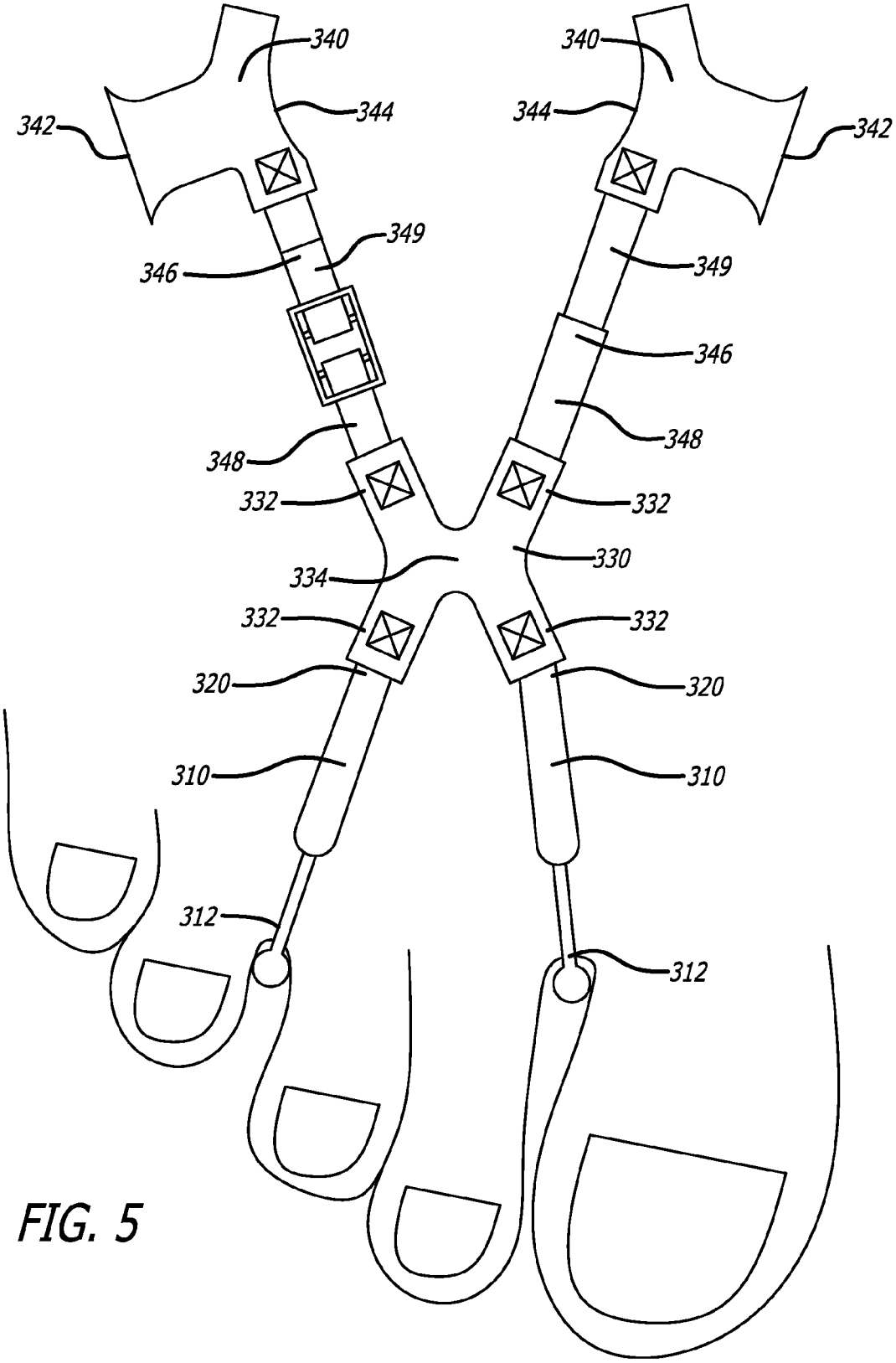
FIG. 5 depicts a top view of an example securement mechanism for a sport sandal in accordance with one embodiment of the present disclosure.
Figure 6:
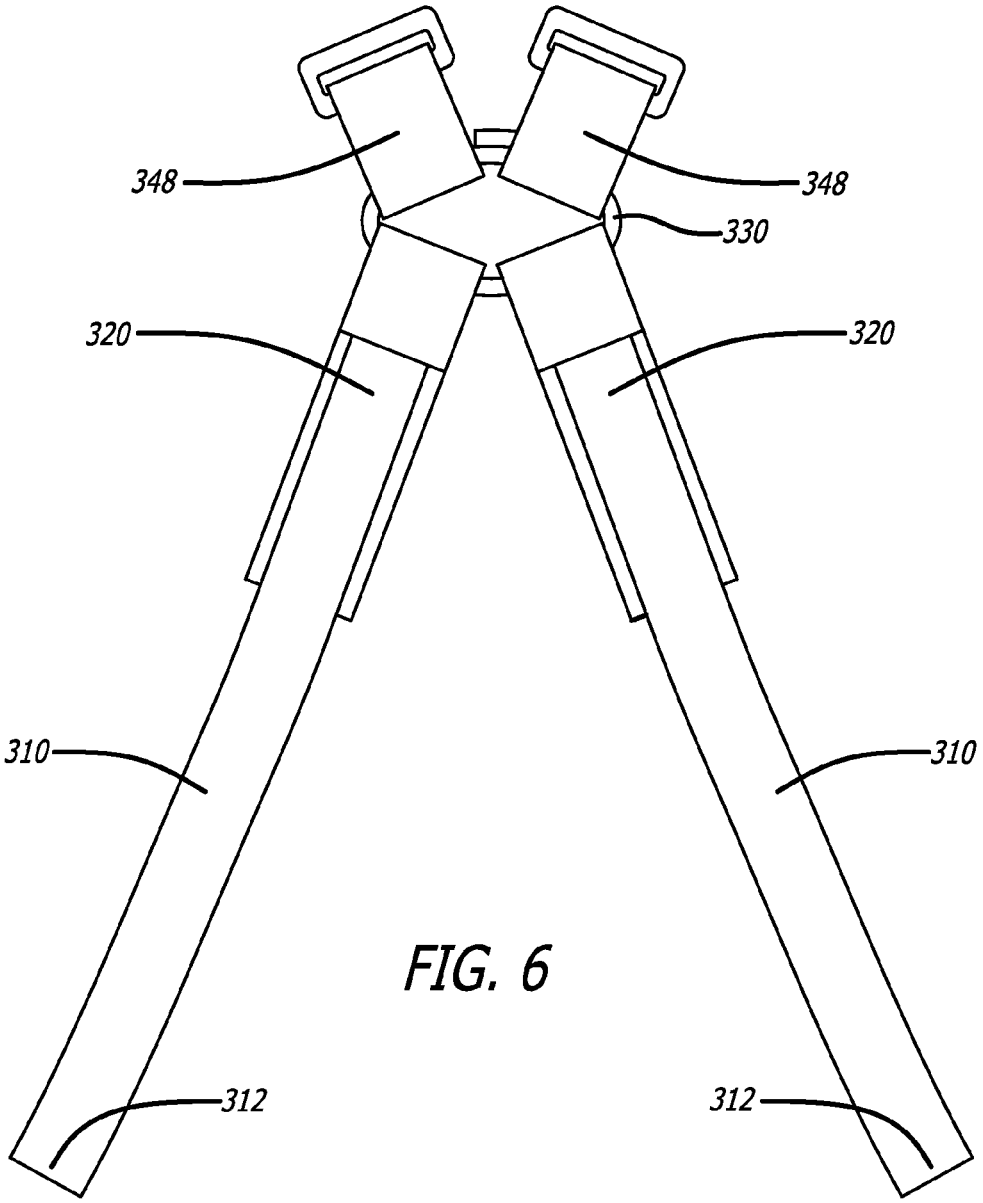
FIG. 6 depicts a top view of an example securement mechanism for a sport sandal in accordance with one embodiment of the present disclosure.

In embodiments, the first ends 312 of the plurality of toe posts 310 may be coupled to the sole 200 at a location such that each of the toe posts 310 may fit directly between two toes when worn by a user, wherein each of the toe posts 310 fits directly between a different pair of toes. For example, as illustrated in FIG. 5, one of the toe posts 310 may fit between a first toe and a second toe, and the second toe post 310 may fit between a third toe and a fourth toe. In embodiments, the toe posts 310 may extend from the sole 200 in between two of the user's toes and over the top and/or side of the user's foot to the second end 320 of the toe post 310, which may coupled to the brace 330. In other implementations, the toe posts 310 may extend from the sole 200 on the outer edge of the user's foot and over the side and/or top of the user's foot to the second end 320 of the toe post 310, which may be coupled to the brace 330. In other examples, both toe posts 310 may be located on the outer edge of the user's foot. In implementations, one toe post 310 may extend between the user's toes while the other toe post 310 may be located on the outer edge of the user's foot.

In implementations, the sport sandal 100 may comprise three or more toe posts 310. For instance, in some examples there may be three toe posts 310. In such implementations, each toe post 310 may be configured to fit either in between the user's toes or on the outside of the user's foot—e.g., one example where two toe posts 310 are between the user's toes and one is located on the outer edge of the user's foot, or another example where all three toe posts 310 are between the user's toes. In yet another example, there may be four toe posts 310 in any combination of the four toe posts 310 being located between the user's toes and on the outside edge of the user's foot. In an example with four toe posts 310, where each is located between the user's toes, a five-toed user would have a separate toe post 310 that extends between each of the user's toes. The incorporation of a plurality of toe posts 310 strengthens the connection between the sandal and the foot. Additionally, having a plurality of toe posts 310 relieves the average strain experienced by each toe post 310 through the distribution of force. Further, the present solution also offers a user a variety of options in selecting where to place the toe posts according to the user's preference (i.e., in between two toes or on the outside of the user's foot).

The securement mechanism 300 may also include a brace 330. As explained above, the second ends of each of the plurality of toe posts 310 may couple to the brace 330. In some examples, the brace 330 may be a closed ring (See, for example, FIG. 6). Although the term ring is used, the brace 330 of this example is not necessarily circular, it can be any shape, such as square, diamond, triangle, or any other multi-sided geometric shape. The brace 330 can be formed of a flexible or rigid material that forms a closed curve. In such examples, the ring shape of the brace 330 may pass through the closed loop located at the second end 320 of the toe post 310, thus coupling the brace 330 to the toe post 310.

In another example, as shown for example in FIGS. 4 and 5, the brace 330 may be comprised of a plurality of appendages 332 extending from a center point 334. In such examples, each appendage 332 may be coupled to another component of the securement mechanism 300. For example, in embodiments with only two toe posts 310, there may be at least two appendages 332, wherein each toe post 310 couples to one of the appendages 332. In such examples, the toe posts 310 may couple to the appendage 332 by any coupling means, such as hook and loop fasteners, a buckle, or a more permanent affixment (e.g., rivets or stitching). In some examples, the brace 330 may located at a central position with respect to the sole 200. In such examples, when a user is wearing the sport sandal 100, the brace 330 may be located on top of the user's foot at a roughly central location, similar to where the knot would be tied in a pair of laced shoes. The brace 330 may be made of the same material as the toe straps 310, or additionally may be a rigid or hard plastic material or a metal material.

The securement mechanism 300 may also include a plurality of lateral supports 340, which may couple to the brace 330. The plurality of lateral supports 340 may include a first end 342 coupled to the sole 200. In one embodiment, the first end 342 of each of the plurality of lateral supports 340 may be coupled to the sole 200 in the same manner as the first end 312 of the plurality of the toe posts 310, as described herein. The plurality of lateral supports 340 may extend substantially vertically (i.e., substantially perpendicular to the plane of the sole) to a second end 344, which may couple to the brace 330. In some examples, a strap 346 may couple the second end 344 of the lateral support 340 to the brace 330. In such examples, the strap 346 may be an elastic material that allows the securement mechanism 300 to accommodate feet of various sizes. In other examples, a set of two straps 346 may couple the second end 344 of the lateral support 340 to the brace 330. In such examples, a first strap 348 may be coupled to the brace 330 and a second strap 349 may be coupled to the lateral support 340.

In implementations, the first 348 and second straps 349 may be coupled to each other. For example, in embodiments where the brace 330 forms a ring, the first strap 348 may have an end formed into a closed loop through which the ring passes and an opposite end. The opposite end may then couple to the second strap 349 by hook and loop fasteners, a buckle, or other coupling means. This type of coupling between the first strap 348 and the second strap 239 allows for the securement mechanism 300 to accommodate feet of various sizes and the tightening or loosening of the securement mechanism 300. In another example, if the brace 330 has the plurality of appendages 332, the first strap 348 may couple to one of the appendages 332 by any means previously discussed (e.g., hook and loop fasteners, stitching, rivets, or formed as part of the brace 330).

In implementations, the other end of the first strap 348 may couple to the second strap 349. The second strap 349 of any of the embodiments discussed herein may be coupled to the lateral support 340 by any coupling means previously discussed (e.g., hook and loop fasteners, stitching, rivets, formed as part of the lateral support 340, etc.). The plurality of lateral supports 340 may be located anywhere from the center of the sole 200 to the rear edge of the sole 200. In some examples, the lateral supports 340 may be located on the sole 200 at a position where the lateral supports 340 will be in line with a user's ankle bone while wearing the sport sandal 100. In the examples depicted, there may be two toe posts 310 and two lateral supports 340, each of which may be coupled to the brace 330. In such examples, the securement mechanism 300 is comprised of a quad brace 330 system. In embodiments, the brace 330 of the quad-brace system may have four components coupled thereto.

The securement mechanism 300 may also include a heel leash 350. In some examples, the heel leash 350 may include a first end 352 and a second end 354. In such examples, the first end 352 may couple to one lateral support 340 and the second end 354 may couple to the other lateral support 340. In such examples, when a user is wearing the sport sandal, the heel leash 350 extends around the back of the user's foot. The heel leash 350 may be coupled to each of the lateral supports 340 by buckles or hook and loop fasteners or other means such that the length of the heel leash can be varied to accommodate different foot sizes.

In other examples, the securement mechanism 300 may not include the lateral supports 340. In such examples, the strap coupling 346 the brace 330 to the lateral supports 340 would instead couple the brace 330 to a point on the sole 200. Similarly, the heel leash 350 would also couple to the sole 200 instead of to the lateral support 340.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

As used herein, the verb "to comprise" in this description, claims, and other conjugations are used in its non-limiting sense to mean those items following the word are included, but items not specifically mentioned are not excluded.

Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more."

As used herein in the specification and claims, including as used in the examples and unless otherwise expressly specified, all numbers may be read as if by prefaced by the word "about" or "approximately," even if the term does not expressly appear. The phrase "about" or "approximately" may be used when describing magnitude and/or position to indicate that the value and/or position described is within a reasonable expected range of values and/or positions.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be terms a second element, region, layer, or section without departing from the teachings of the embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary illustrations. As will become apparent to one of ordinary skill in the art after reading this document, the illustrated embodiments and their various alternatives can be implemented without confinement to the illustrated examples.

The invention claimed is:

1. A sport sandal, comprising:

a sole; and a securement mechanism, comprising:

a plurality of toe posts;

a plurality of lateral supports;

a plurality of adjustable straps;

a brace coupled to the plurality of toe posts and the plurality of lateral supports, the brace being coupled to the plurality of lateral supports via the plurality of adjustable straps; and a heel strap coupled to the plurality of lateral supports;

wherein each of the plurality of toe posts has a first end and a second end;

wherein the first end of each of the plurality of toe posts is coupled to the sole;

wherein the second end of each of the plurality of toe posts is individually coupled to the brace;

wherein each of the plurality of adjustable straps has a first end forming a closed loop and a second end;

wherein the first end of each of the plurality of adjustable straps is coupled to the brace, with the brace extending through the closed loop formed by the first end of each of the plurality of adjustable straps; and wherein the second end of each of the plurality of adjustable straps is coupled to one of the plurality of lateral supports.

2. The sport sandal of claim 1, wherein the plurality of toe posts comprises two toe posts.

3. The sport sandal of claim 1, wherein the brace is a ring.

4. The sports sandal of claim 3, wherein the second end of each of the plurality of toe posts forms a closed loop; and the ring extends through the closed loop formed by the second end of each of the plurality of toe posts.

5. The sports sandal of claim 2, wherein:

the sport sandal comprises only two toe posts;

the first end of one of the two toe posts is configured to be located between the first toe and the second toe of a wearer when the sport sandal is worn; and the first end of the other of the two toe posts is configured to be located between the third and the fourth toes of the wearer when the sport sandal is worn.

6. The sports sandal of claim 2, wherein:

the plurality of lateral supports comprises two lateral supports;

the heel strap has a first end and a second end;

the first end of the heel strap is coupled to one of the two lateral supports; and the second end of the heel strap is coupled to the other of the two lateral supports.

7. The sport sandal of claim 1, wherein each of the plurality of toe posts has its own connection to the brace.

8. The sport sandal of claim 1, wherein each of the plurality of lateral supports has its own connection to the brace.

9. The sports sandal of claim 1, wherein the brace is configured to be located atop the foot of a wearer when the sport sandal is worn.

10. The sports sandal of claim 1, wherein each of the plurality of lateral supports is coupled to the sole at a location proximate the ankle bones of a wearer of the sport sandal.

11. The sports sandal of claim 1, wherein the heel strap has an adjustable length.

12. The sports sandal of claim 1, wherein each of the plurality of adjustable straps comprises:

a first portion having one side of a hook-and-loop fastener; and a second portion having the other side of the hook-and-loop fastener.

13. The sports sandal of claim 2, wherein:

the plurality of lateral supports comprises two lateral supports;

the brace comprises four appendages extending from a center point;

each of the two toe posts couples to a first two of the four appendages; and each of the two lateral supports couples to a second two of the four appendages.

14. A sport sandal comprising:

a sole;

a pair of toe posts, each having a first end coupled to the sole, and a second end opposite the first end;

a brace coupled to the second end of each of the pair of toe posts;

a pair of adjustable straps, each having a first end coupled to the brace, and a second end opposite the first end;

a pair of lateral supports, each coupled to the sole and to the second end of one of the pair of adjustable straps; and an adjustable-length heel strap having a first end coupled to one of the pair of lateral supports, and a second end coupled to the other of the pair of lateral supports;

wherein the first end of one of the pair of toe posts is configured to be located between the first toe and the second toe of a wearer when the sport sandal is worn;

wherein the first end of the other of the pair of toe posts is configured to be located between the third and the fourth toes of the wearer when the sport sandal is worn; and wherein the brace is configured to be located atop the foot of the wearer when the sport sandal is worn.

15. The sports sandal of claim 14, wherein:

the brace is ring-shaped;

the second end of each of the pair of toe posts forms a closed loop;

the ring extends through the closed loop formed by the second end of each of the pair of toe posts;

the first end of each of the pair of adjustable straps forms a closed loop; and the ring further extends through the closed loop formed by the first end of each of the pair of adjustable straps.

16. The sports sandal of claim 14, wherein:

the brace comprises four appendages extending from a center point;

each of the pair of toe posts couples to a first two of the four appendages; and each of the pair of adjustable straps couples to a second two of the four appendages.

17. A sport sandal comprising:

a sole;

a pair of toe posts, each having a first end coupled to the sole, and a second end that forms a closed loop;

a ring-shaped brace that extends through the closed loop formed by the second end of each of the pair of toe posts;

a pair of adjustable straps, each having a first end that forms a closed loop through which the brace extends, and a second end opposite the first end;

a pair of lateral supports, each coupled to the sole and to the second end of one of the pair of adjustable straps; and an adjustable-length heel strap having a first end coupled to one of the pair of lateral supports, and a second end coupled to the other of the pair of lateral supports;

wherein the first end of one of the pair of toe posts is configured to be located between the first toe and the second toe of a wearer when the sport sandal is worn;

wherein the first end of the other of the pair of toe posts is configured to be located between the third and the fourth toes of the wearer when the sport sandal is worn; and wherein the brace is configured to be located atop the foot of the wearer when the sport sandal is worn.

18. A sport sandal, comprising:

a sole; and a securement mechanism, comprising:

two toe posts;

two lateral supports;

a brace coupled to the plurality of toe posts and the plurality of lateral supports; and a heel strap coupled to the plurality of lateral supports;

wherein each of the plurality of toe posts has a first end and a second end;

wherein the first end of each of the plurality of toe posts is coupled to the sole;

wherein the second end of each of the plurality of toe posts is individually coupled to the brace;

wherein the brace comprises four appendages extending from a center point;

wherein each of the two toe posts couples to a first two of the four appendages; and wherein each of the two lateral supports couples to a second two of the four appendages.

* * * * *